US010007222B2

(12) United States Patent
Yagi et al.

(10) Patent No.: US 10,007,222 B2
(45) Date of Patent: Jun. 26, 2018

(54) CARTRIDGE, IMAGE FORMING APPARATUS AND QUALITY DETERMINING METHOD OF CARTRIDGE

(71) Applicants: KABUSHIKI KAISHA TOSHIBA, Tokyo (JP); TOSHIBA TEC KABUSHIKI KAISHA, Tokyo (JP)

(72) Inventors: Norifumi Yagi, Tokyo (JP); Takao Ishida, Kanagawa (JP); Kanya Hiroi, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/392,959

(22) Filed: Dec. 28, 2016

(65) Prior Publication Data

US 2017/0108810 A1 Apr. 20, 2017

Related U.S. Application Data

(63) Continuation of application No. 14/816,452, filed on Aug. 3, 2015, now Pat. No. 9,533,524, which is a continuation of application No. 14/010,982, filed on Aug. 27, 2013, now Pat. No. 9,128,442.

(51) Int. Cl.

| | |
|---|---|
| ***G03G 15/00*** | (2006.01) |
| ***G03G 15/08*** | (2006.01) |
| ***B41M 7/00*** | (2006.01) |

(52) U.S. Cl.

CPC ..... *G03G 15/556* (2013.01); *B41M 7/0009* (2013.01); *B41M 7/009* (2013.01); *G03G 15/0863* (2013.01); *G03G 2215/0695* (2013.01)

(58) Field of Classification Search

CPC ..... G03G 15/556; G03G 15/0863; G03G 2215/0695; B41M 7/009; B41M 7/0009

See application file for complete search history.

(56) References Cited

U.S. PATENT DOCUMENTS

| | | | |
|---|---|---|---|
| 5,394,231 | A | 2/1995 | Sudo et al. |
| 7,149,437 | B2 | 12/2006 | Okubo |
| 7,180,532 | B2 | 2/2007 | Slattery et al. |
| 7,642,024 | B2 | 1/2010 | Furuya |
| 7,923,183 | B2 | 4/2011 | Ito |

(Continued)

FOREIGN PATENT DOCUMENTS

| | | |
|---|---|---|
| JP | 2008-268501 | 11/2008 |
| JP | 2009-288274 | 12/2009 |

*Primary Examiner* — David Bolduc

(74) *Attorney, Agent, or Firm* — Patterson & Sheridan, LLP

(57) ABSTRACT

An image forming apparatus according to an embodiment includes an image forming section having a cartridge detachably mounted thereto. The cartridge holds a color erasable material which is erasable by heating to a color erasing temperature. The cartridge includes a housing configured to hold the color erasable material and a temperature sensing unit configured to detect a storage temperature of the housing. The apparatus includes a display unit and a control section. The control section receives a maximum storage temperature of the housing, and determines whether the received maximum storage temperature is greater than the color erasing temperature. The control section controls the display unit to display a message indicating whether the received maximum storage temperature is greater than the color erasing temperature.

14 Claims, 7 Drawing Sheets

(56) References Cited

U.S. PATENT DOCUMENTS

| | | | |
|---|---|---|---|
| 8,260,188 | B2 | 9/2012 | Yahata et al. |
| 2006/0088350 | A1 | 4/2006 | Imamiya |
| 2006/0115283 | A1 | 6/2006 | Yamauchi et al. |
| 2006/0269328 | A1 | 11/2006 | Ochiai |
| 2007/0231723 | A1 | 10/2007 | Kimura et al. |
| 2007/0274747 | A1 | 11/2007 | Kimura et al. |
| 2007/0280722 | A1 | 12/2007 | Katada et al. |
| 2007/0286644 | A1 | 12/2007 | Takegawa |
| 2008/0012926 | A1 | 1/2008 | Hara et al. |
| 2008/0025735 | A1 | 1/2008 | Odani |
| 2008/0145067 | A1 | 6/2008 | Maeda et al. |
| 2009/0110440 | A1 | 4/2009 | Hornma et al. |
| 2009/0136242 | A1 | 5/2009 | Okamoto et al. |
| 2009/0153921 | A1 | 6/2009 | Maeyama |
| 2009/0154970 | A1 | 6/2009 | Yoshida et al. |
| 2010/0118349 | A1 | 5/2010 | Ozawa |
| 2010/0129095 | A1 | 5/2010 | Yoo et al. |
| 2010/0272449 | A1 | 10/2010 | Yoshida et al. |
| 2010/0290812 | A1 | 11/2010 | Taguchi et al. |
| 2011/0033216 | A1 | 2/2011 | Taki et al. |
| 2011/0199625 | A1 | 8/2011 | Sugimoto et al. |
| 2011/0212397 | A1 | 9/2011 | Aoki et al. |
| 2011/0262197 | A1 | 10/2011 | Imamiya et al. |
| 2011/0304881 | A1 | 12/2011 | Saitou |
| 2012/0002987 | A1 | 1/2012 | Odani |
| 2012/0092713 | A1 | 4/2012 | Hagiwara |
| 2012/0170064 | A1 | 7/2012 | Hibino et al. |
| 2012/0257264 | A1 | 10/2012 | Megawa |
| 2012/0327487 | A1 | 12/2012 | Kamisuwa et al. |
| 2013/0003134 | A1 | 1/2013 | Hazu et al. |
| 2013/0016375 | A1 | 1/2013 | Hashidume et al. |
| 2013/0016376 | A1 | 1/2013 | Hashidume et al. |
| 2013/0029257 | A1 | 1/2013 | Fujita et al. |
| 2013/0070305 | A1 | 3/2013 | Tomizawa et al. |
| 2013/0077983 | A1 | 3/2013 | Kashiwagi |
| 2013/0236196 | A1 | 9/2013 | Shinohara |
| 2014/0063511 | A1 | 3/2014 | Tomizawa |
| 2014/0064750 | A1 | 3/2014 | Hara et al. |
| 2014/0193168 | A1 | 7/2014 | Kimoto |
| 2014/0211265 | A1 | 7/2014 | Phillips et al. |
| 2014/0212157 | A1 | 7/2014 | Ishikawa |
| 2014/0212160 | A1 | 7/2014 | Fukaya |

CARTRIDGE, IMAGE FORMING APPARATUS AND QUALITY DETERMINING METHOD OF CARTRIDGE

CROSS REFERENCE TO RELATED APPLICATIONS

This application is a continuation of U.S. patent application Ser. No. 14/816,452, filed on Aug. 3, 2015, which is a continuation of U.S. patent application Ser. No. 14/010,982, filed on Aug. 27, 2013, now U.S. Pat. No. 9,128,442, issued on Sep. 8, 2015, the entire contents of each of which are incorporated herein by reference.

FIELD

Embodiments described herein relate to a cartridge for managing the state of a developing agent or ink and the like in a copier or printer, an image forming apparatus and a quality determining method of a cartridge.

BACKGROUND

There is an apparatus for exchanging the cartridge in a multi-function peripheral (MFP) or printer for holding consumables such as toner or ink. An apparatus using the cartridge includes an apparatus for determining whether or not a new exchanged cartridge is an approved cartridge. However, if the color material of the toner or ink in a cartridge is a color erasable material which is erasable by heating, the color erasable material may be erased in a high-temperature environment even if the cartridge is unused. Therefore, if a color erasable material is housed in a cartridge, in addition to a determination on whether or not a cartridge is approved, a determination on the quality of the cartridge is also needed to be carried out.

DETAILED DESCRIPTION

Figure 1:
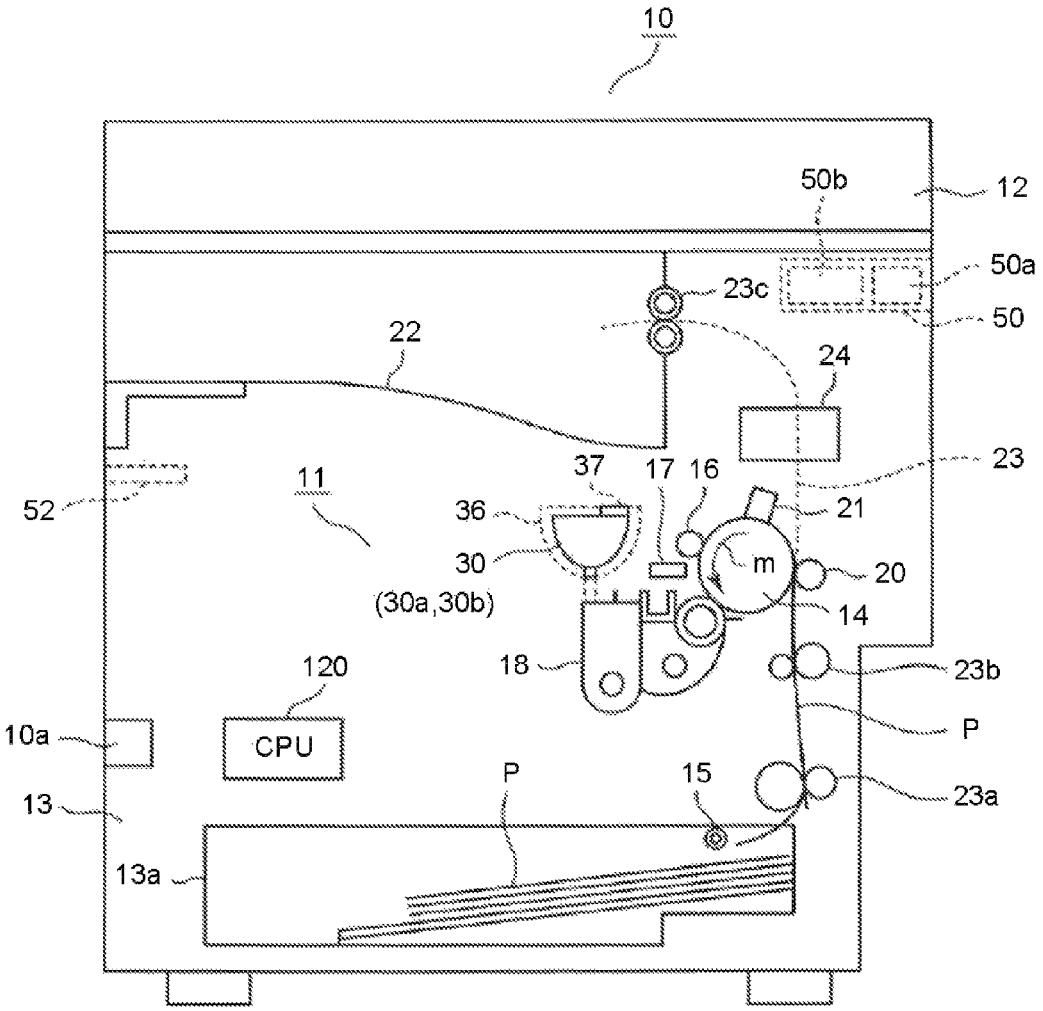
FIG. 1 is a diagram of a Multi-Function Peripheral (MFP), according to a first embodiment.

A cartridge according to an embodiment comprises a housing configured to hold a color erasable material which is erasable by heating to a color erasing temperature. The cartridge further comprises a temperature sensing unit configured to detect a temperature of the housing and a recording section configured to record the detected temperature of the housing.

Embodiments are described below.

Embodiment 1

The image forming apparatus of an embodiment 1 is described below with reference to accompanying drawings FIG. 1-FIG. 5. An MFP (Multi-Function Peripheral) 10 serving as an image forming apparatus shown in FIG. 1 includes a printer section 11, a scanner section 12, a paper feed section 13 and a paper discharge section 22. The MFP 10 includes a CPU 120 serving as a control section for controlling the whole MFP 10.

The MFP 10 includes a control panel 50. The control panel 50 includes an operation panel 50*a* and a touch panel type display 50*b*. The operation panel 50*a* accepts an input of, for example, a user. The display 50*b* accepts the input of, for example, a user and/or displays information for the user.

The MFP 10 includes a card reader 52 serving as a medium reading section. The card reader 52 reads an integrated circuit (IC) card for resetting a timer or a counter which records the usage amount of a consumable such as a photoconductive drum 14 or a developer 18 when the consumable is exchanged. The MFP 10 is connected with a telephone line or a computer terminal via an interface 10*a*.

The paper feed section 13 has a paper feed cassette 13*a* including a paper feed roller 15. A sheet P is stored in the paper feed cassette 13*a*. The sheet P stored in the paper feed cassette 13*a* may be either of an unused sheet or a reused sheet (i.e., a sheet erased through an image erasing process).

The MFP 10 includes a conveyance path 23 for conveying the sheet P from the paper feed section 13, through the printer section 11, and to the paper discharge section 22. The conveyance path 23 includes a conveyance roller 23*a*, a resist roller 23*b* and a paper discharge roller 23*c*.

The printer section 11 is, for example, an electrophotographic type printer which forms an image with color erasable toner serving as a color erasable material in which the color is erased by heating. The printer section 11 includes a charger 16, an exposure scanning head 17, a developer 18 and a cleaner 21 around a photoconductive drum 14 rotating in the direction indicated by the arrow m. The charger 16 charges the photoconductive drum 14. The exposure scanning head 17 radiates exposure light towards the photoconductive drum 14 based on image data to form an electrostatic latent image on the photoconductive drum 14.

The developer 18 feeds toner for the electrostatic latent image on the photoconductive drum 14 with, for example, a two-component developing agent composed of a mixture of toner and a magnetic carrier. The toner refers to color erasable toner which can be erased at a color erasing temperature.

The color erasable toner includes a coloring agent, a color generation compound and a color developing agent in binder resin. If a fixed toner image formed with the color erasable toner is heated to the color erasing temperature, then the color generation compound and the color developing agent in the color erasable toner are dissociated to erase the toner image. For example, the color erasable toner can be fixed on a sheet at a relatively low temperature and erased at a temperature higher than the fixing temperature, for example at about 10 degrees centigrade higher.

A transfer device 20 transfers the toner image formed on the photoconductive drum 14 onto the sheet P. The charger 16, the exposure scanning head 17, the developer 18 and the transfer device 20 constitute an image forming section.

The printer section 11 includes a cartridge inserting section 36 of the MFP 10 above the developer 18. A toner cartridge 30 is installed in the cartridge inserting section 36 in an exchangeable manner. The toner cartridge 30 holds the color erasable toner and replenishes the color erasable toner to the developer 18. The printer section 11 has a fixer 24 which is arranged between the photoconductive drum 14 and the paper discharge section 22 along the conveyance path 23. The fixer 24 heats the toner image formed on the sheet P to a fixing temperature (lower than the color erasing temperature) to fix the toner image on the sheet P without erasing the toner image.

With the configuration above, the MFP 10 forms, by using the printer section 11, a printed image on the sheet P fed from the paper feed section 13 with the color erasable toner, and discharges the sheet P to the paper discharge section 22.

The fixer 24 may also be used as a heater for erasing the printed image formed on the sheet P with the color erasable toner. Accordingly, the MFP 10 may also function as a color erasing apparatus.

The image forming apparatus, which is not limited to the MFP 10, may further be a monochromatic image forming apparatus, and no limitation is given to the number of the developing apparatus. The image forming apparatus may transfer a toner image onto a sheet directly from a photoconductive member. Besides, the image forming apparatus may comprise a plurality of printer sections. The image forming apparatus may further be an inkjet type image forming apparatus using a color erasable ink, that is, color erasable material which is erasable by heating.

If the toner cartridge 30 runs out of toner during the printing period of the printer section 11, the MFP 10 displays information 'exchange toner cartridge' on the display 50*b*. If the information ' exchange toner cartridge' is displayed on the display 50*b*, the user exchanges the used toner cartridge 30*a* for an unused toner cartridge 30*b*.

Figure 2:
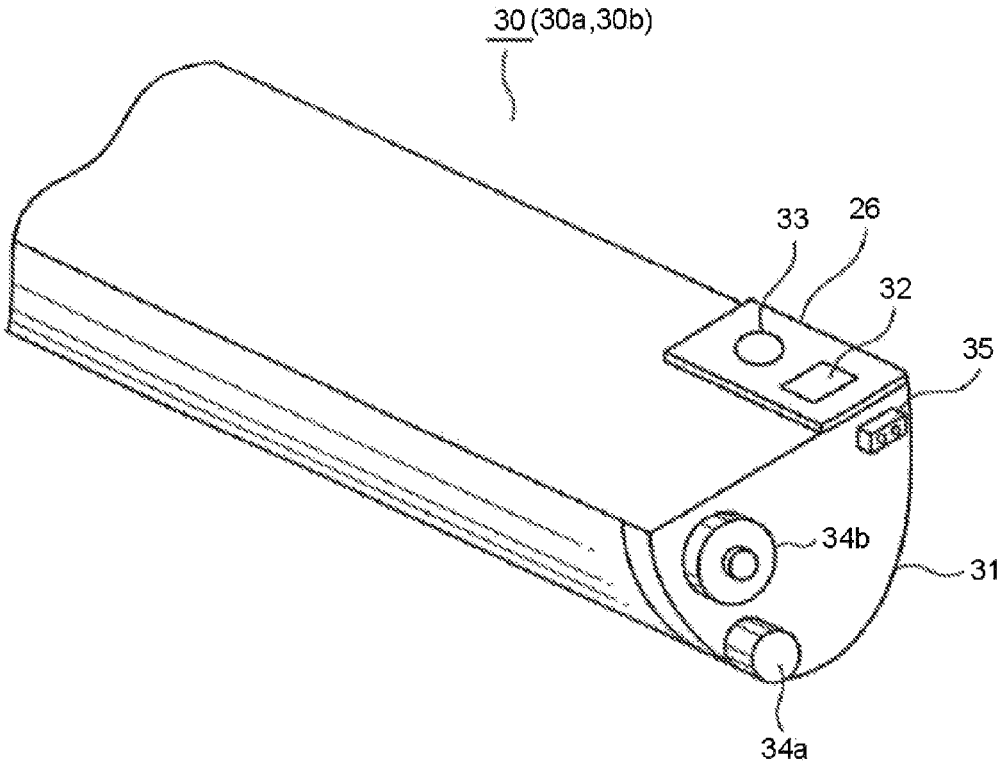
FIG. 2 is a partial perspective view illustrating a toner cartridge, according to the first embodiment.
Figure 3:
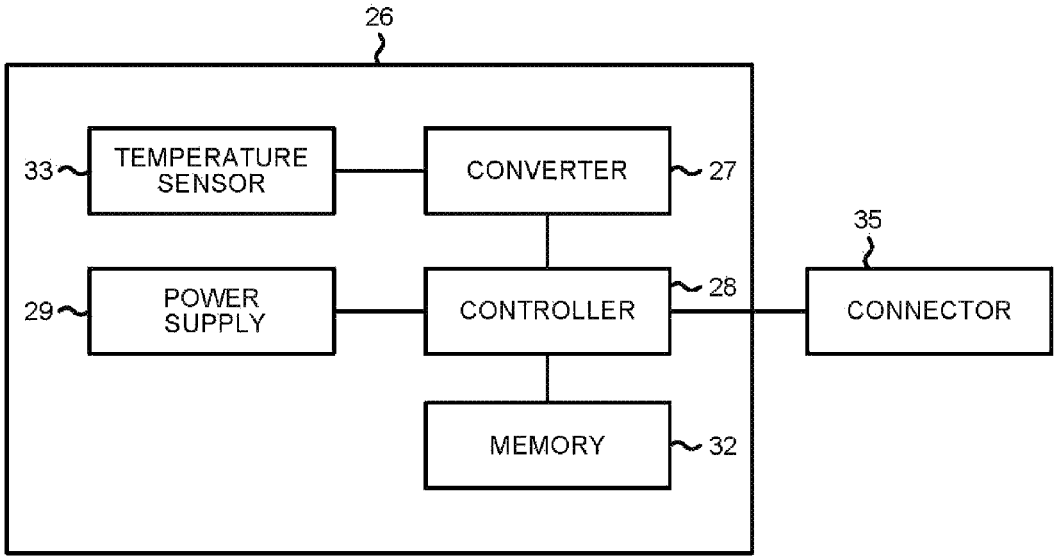
FIG. 3 is a diagram illustrating a temperature sensor unit, according to the first embodiment.
Figure 4:
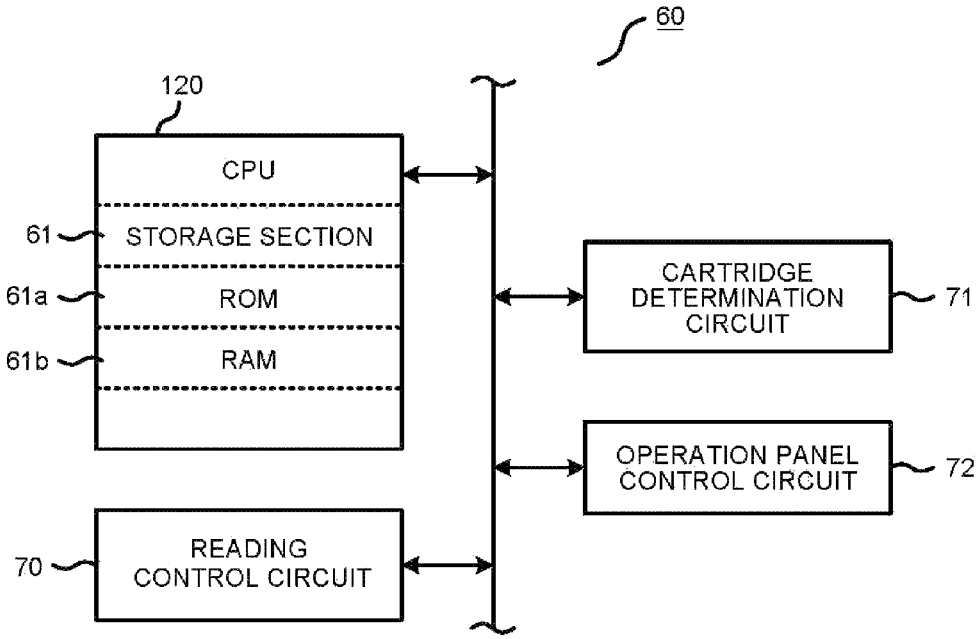
FIG. 4 is a block diagram illustrating a control system for determining the quality of the toner cartridge, according to the first embodiment.

As shown in FIG. 2 and FIG. 3, the toner cartridge 30 holding a color erasable toner includes a housing 31, a toner supplying section 34*a*, a supplying section driving gear 34*b*, a connector 35 and a temperature sensor unit 26. The connector 35 is an interface which is electrically connected with the MFP 10 when the toner cartridge 30 is incorporated into the cartridge inserting section 36 of the MFP 10. The temperature sensor unit 26 includes a temperature memory 32 serving as a recording section, a temperature sensor 33 serving as a temperature detection section, a converter 27, a controller 28 and a power supply 29.

The temperature sensor 33 detects the temperature of the toner cartridge 30 during a storage period from the time that the toner cartridge 30 is manufactured to the time that the toner cartridge 30 is delivered to the user. The converter 27 converts the electric signal from the temperature sensor 33 and sends the converted signal to the controller 28. The controller 28 writes the temperature detected by the temperature sensor 33 into the temperature memory 32. Additionally, the controller 28 is electrically connected with the connector 35. That is, in a condition that the toner cartridge 30 is incorporated into the cartridge inserting section 36 of the MFP 10, the temperature data held by the temperature memory 32 is transferred to the MFP 10 via the connector 35. The temperature memory 32 includes, for example, a nonvolatile memory such as an EEPROM, a Flash ROM or a flash memory. The temperature memory 32 records the detection result of the temperature sensor 33 as a temperature record (temperature data) of the toner cartridge 30. The temperature data recorded in the temperature memory 32 is referred hereinafter to as management temperature. If the management temperature recorded in the temperature memory 32 is higher than color erasing temperature of a toner, the color erasable toner in the toner cartridge 30 is thermally erased.

The temperature memory 32 is capable of rewriting the management temperature successively so as to only store the maximum temperature detected by the temperature sensor 33.

The power supply 29 supplies power to the controller 28 so that the controller 28 can write temperature data into the temperature memory 32.

The MFP 10 includes a cartridge reading section 37, serving as a record reading section, in the cartridge inserting section 36. The cartridge reading section 37 reads the management temperature recorded in the temperature memory 32 of the unused toner cartridge 30*b* when the toner cartridge 30 is exchanged.

When the toner cartridge 30 is exchanged, the CPU 120 determines the quality of the unused toner cartridge 30*b*. A control system 60 for determining the quality of the unused toner cartridge 30*b* is described with reference to the block diagram shown in FIG. 4. The control system 60 includes a reading control circuit 70, a cartridge determination circuit 71 and an operation panel control circuit 72. The control system 60 is controlled by the CPU 120 (which controls the whole MFP 10).

The CPU 120 executes instructions stored in the storage section 61 to perform a printing function using the color erasable toner. The storage section 61 includes a ROM (Read Only Memory) 61*a* and a RAM (Random Access Memory) 61*b*. A control method and control data for of basic actions of an image forming processing are stored in the ROM 61*a*. The toner color erasing temperature of the color erasable toner used by, for example, the developer 18, is stored in the ROM 61*a*. The RAM 61*b* is a working memory for temporarily storing the maximum temperature read by the cartridge reading section 37.

The reading control circuit 70 controls the cartridge reading section 37 to read the temperature memory 32. The cartridge determination circuit 71 determines the quality of the unused toner cartridge 30*b* according to the management temperature recorded in the temperature memory 32 read by the cartridge reading section 37. The operation panel control circuit 72 controls the operation panel 50*a* and the display 50*b*.

Figure 5:
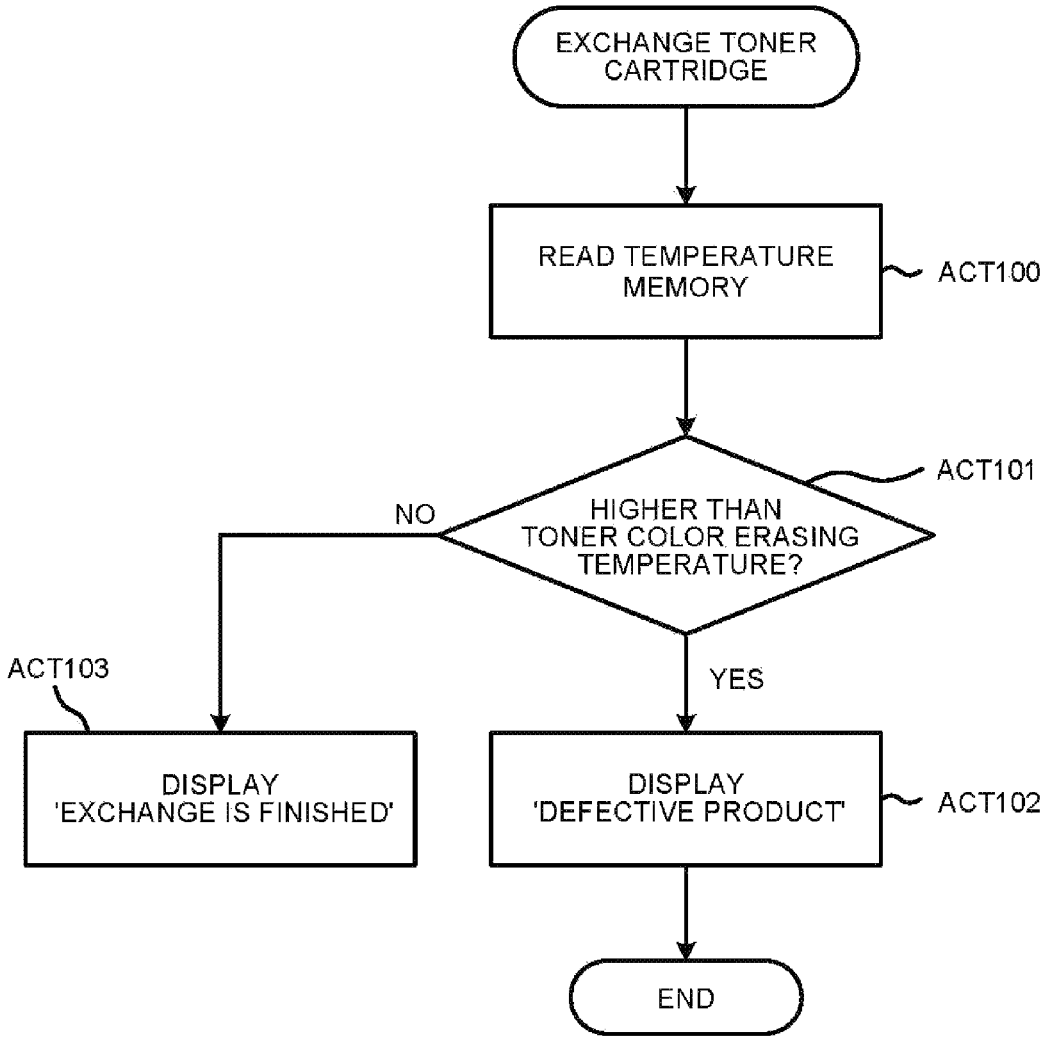
FIG. 5 is a flowchart illustrating the quality determination for an unused toner cartridge, according to the first embodiment.

The quality determination process conducted for the unused toner cartridge 30*b* installed in the MFP 10 when the toner cartridge 30 is exchanged is now described with reference to the flowchart shown in FIG. 5. If the user exchanges the toner cartridge 30, the CPU 120 starts to determine the quality of the unused toner cartridge 30*b*.

The cartridge reading section 37 reads the temperature memory 32 under the control of the reading control circuit 70 (ACT 100). The cartridge determination circuit 71 compares the highest management temperature read by the cartridge reading section 37 from the temperature memory 32 with the toner color erasing temperature stored in the ROM 61*a* (ACT 101).

If the highest management temperature is higher than the toner color erasing temperature (Yes in ACT 101), then the cartridge determination circuit 71 determines that the exchanged unused toner cartridge 30*b* is a defective product. Then, the CPU 120 proceeds to ACT 102. In ACT 102, the operation panel control circuit 72 displays the determination result of the cartridge determination circuit 71 on the display 50*b* of the control panel 50.

In ACT 102, the display 50*b* displays information such as "the installed unused toner cartridge is a defective product" and "please exchange the toner cartridge again." The CPU 120 prompts the user to exchange the installed unused toner cartridge for a new one and ends the quality determination process for of the installed unused toner cartridge 30*b*.

If the highest management temperature is below the toner color erasing temperature (No in ACT 101), then the cartridge determination circuit 71 determines that the exchanged unused toner cartridge 30*b* is a satisfactory product. The CPU 120 proceeds to ACT 103. In ACT 103, the operation panel control circuit 72 displays the determination result of the cartridge determination circuit 71 on the display 50*b* of the control panel 50.

In ACT 103, the display 50*b* displays, for example, "the exchange of the toner cartridge is finished." The CPU 120 ends the quality determination process conducted for the installed unused toner cartridge 30*b*. If the exchanged unused toner cartridge 30*b* is a satisfactory product, then the MFP 10 replenishes color erasable toner from the toner cartridge 30.

The CPU 120 determines the quality of the unused toner cartridge 30*b* every time the user exchanges the toner cartridge 30. The determination result of the cartridge determination circuit 71 may further be displayed on a display of the computer terminal connected with the MFP 10.

According to the first embodiment, the management temperature detected by the temperature sensor 33 during the period from when the toner cartridge 30 is manufactured to the moment when the toner cartridge 30 is delivered to the user is recorded in the temperature memory 32. The temperature memory 32 is read when the toner cartridge 30 is exchanged, and the quality of the unused toner cartridge 30*b* is determined according to the maximum temperature recorded in the temperature sensor 32. If the maximum temperature recorded in the temperature memory 32 reaches the toner color erasing temperature, then it is determined that the color erasable toner in the housing 31 is erased, and that the unused toner cartridge 30*b* is a defective product. The user is notified of the result of the determination of the quality of the unused toner cartridge 30*b*.

The exchange of the cartridge is carried out in a low-temperature environment so as to prevent a defective unused toner cartridge 30*b* having color erasable toner from being installed in the MFP 10. The replenishment of an erased toner from a defective unused toner cartridge 30*b* to the developer 18 is prevented. Thus deterioration of the developer 18 is prevented, and a high-quality printed image can be obtained.

Embodiment 2

Figure 6:
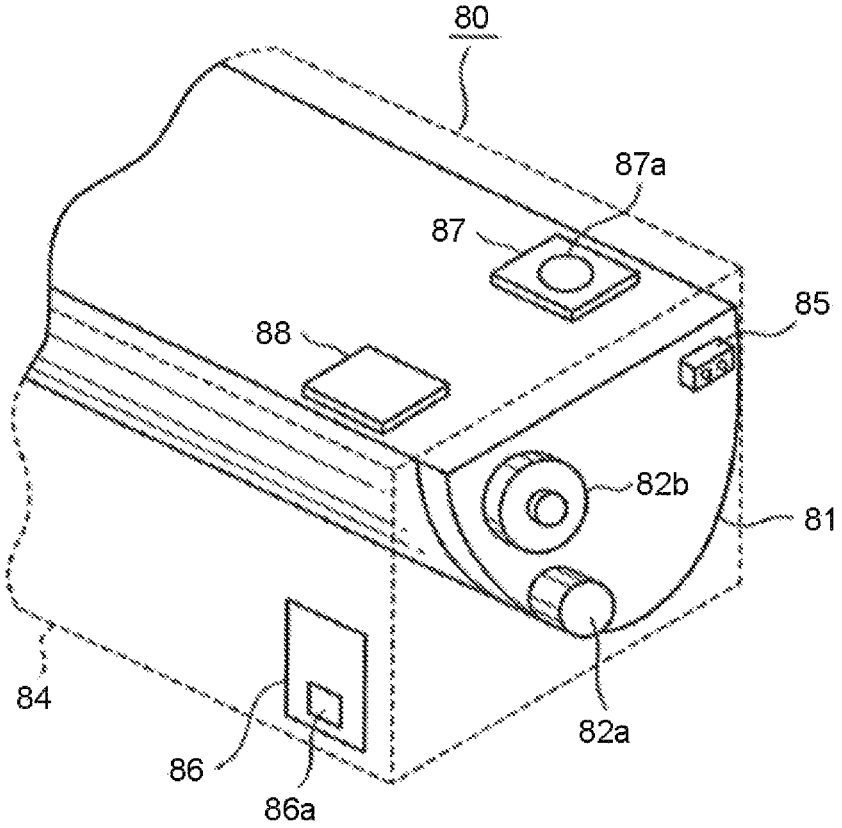
FIG. 6 is a partial perspective view illustrating a toner cartridge and an integrated circuit (IC) card, according to a second embodiment.
Figure 7:
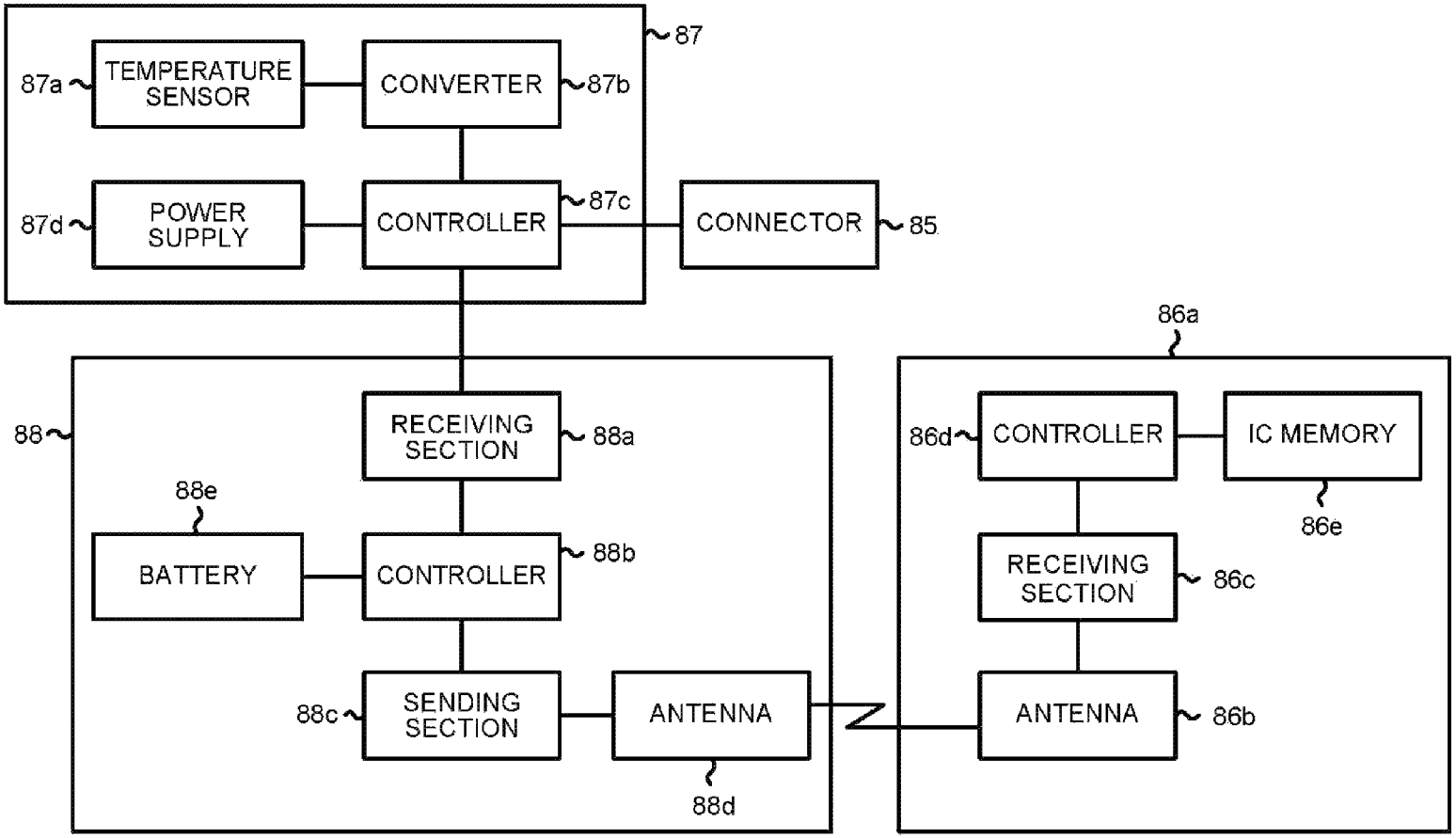
FIG. 7 is a diagram illustrating a RFID system, according to the second embodiment.
Figure 8:
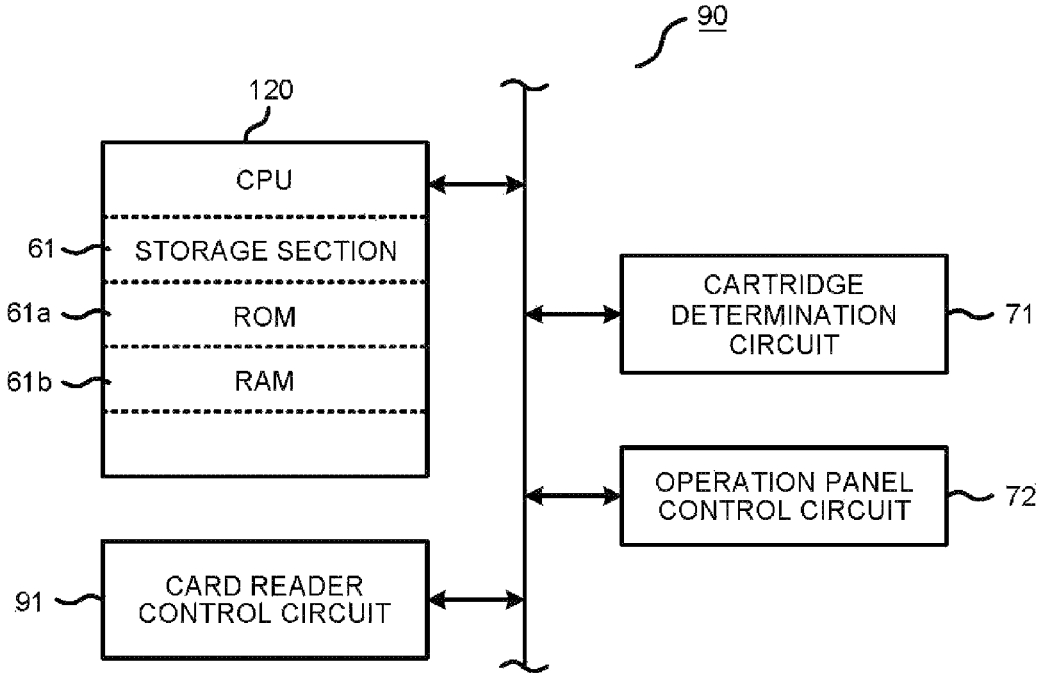
FIG. 8 is a block diagram illustrating a control system for determining the quality of the toner cartridge, according to the second embodiment.

The image forming apparatus of the second embodiment is described below with reference to accompanying drawings FIG. 6-FIG. 8. The difference of the second embodiment compared to the first embodiment is with respect to the structure of the recording medium for recording the management temperature of the cartridge. The configuration of the second embodiment that is the same as that described in the first embodiment is denoted by the same reference symbol and the description thereof is not repeated.

A color erasable toner is held in a toner cartridge 80 installed in the cartridge inserting section 36 in an exchangeable manner. As shown in FIG. 6, the toner cartridge 80 includes a housing 81, a toner supplying section 82*a*, a supplying section driving gear 82*b*, a connector 85, a temperature sensor unit 87 and an IC reader-writer 88. The connector 85 is an interface that electrically connects with the MFP 10. In the second embodiment, records are made in an IC card 86 through the RFID (Radio Frequency Identification) system 130 shown in FIG. 7 in an electromagnetic signal or electromagnetic induction.

The temperature sensor unit 87 includes a temperature sensor 87*a* serving as a temperature detection section, a converter 87*b*, a controller 87*c* and a power supply 87*d*. The temperature sensor 87*a* detects the temperature of the toner cartridge 80 during a storage period from the time that the toner cartridge 80 is manufactured to the time that the toner cartridge 80 is delivered to the user. The converter 87*b* converts the electric signal from the temperature sensor 87*a* and sends the converted signal to the controller 87*c*. The controller 87*c* sends the temperature detected by the temperature sensor 87*a* to the IC reader-writer 88. The controller 87*c* is electrically connected with the connector 85. The power supply 87*d* supplies power for the controller 87*c*.

The IC reader-writer 88 records the electric signal sent from the temperature sensor unit 87 in the IC card 86 in a wireless communication manner. The IC reader-writer 88 includes a receiving section 88*a* for receiving the electric signal from the temperature sensor 87*a*, a controller 88*b*, a sending section 88*c*, an antenna 88*d* and a battery 88*e*. The controller 88*b* converts the electric signal received by the receiving section 88*a* from the temperature sensor 87*a* into a wireless signal through the sending section 88*c* and sends the converted wireless signal from the antenna 88*d*, as an electromagnetic wave signal, for example. The battery 88*e* supplies power for the controller 88*b*.

At time of shipment of the toner cartridge 80, the IC card 86, serving as a recording medium including an IC chip 86*a*, is packed in a package 84 as an accessory. The IC chip 86*a* includes an antenna 86*b*, a receiving section 86*c*, a controller 86*d* and a nonvolatile IC memory 86*e*. The IC chip 86*a* receives, using the receiving section 8, the wireless signal sent from the IC reader-writer 88 through the antenna 86*b*. The controller 86*d* converts the wireless signal received by the receiving section 88*a* into an electric signal serving as the detection result of the temperature sensor 87*a* and writes the electric signal into the IC memory 86*e*. The IC memory 86*e* records the detection result of the temperature sensor 87*a* as the management temperature of the toner cartridge 80.

When exchanging a cartridge, the user installs an unused toner cartridge 80 into the cartridge inserting section 36. The IC card 86 is read with the card reader 52. The CPU 120 controlling the whole MFP 10 determines the quality of the unused toner cartridge 80 according to the management temperature recorded in the IC card 86 read by the card reader 52.

A control system 90 for determining the quality of the unused toner cartridge 80 is described with reference to the block diagram shown in FIG. 8.

The control system 90 includes a CPU 120 for controlling the whole MFP 10. The control system 90 includes a card reader control circuit 91, a cartridge determination circuit 71 and an operation panel control circuit 72 controlled by the CPU 120. The card reader control circuit 91 controls the card reader 52.

If the user exchanges the toner cartridge 80 and the IC card 86 is read with the card reader 52, the CPU 120 starts to determine the quality of the unused toner cartridge 80. If the highest management temperature read by the card reader 52 is higher than the toner color erasing temperature, then the CPU 120 determines that the exchanged unused toner cartridge 80 is a defective product. If the unused toner cartridge 80 is a defective product, then the CPU 120 displays the information for exchanging a new unused toner cartridge 80 on the display 50*b*.

If the highest management temperature read by the card reader 52 is below the toner color erasing temperature, then the CPU 120 determines that the exchanged unused toner cartridge 80 is a satisfactory product. If the unused toner cartridge 80 is a satisfactory product, then the CPU 120 displays the information that the exchange of the toner cartridge is finished on the display 50*b*.

In accordance with the second embodiment, the management temperature of the toner cartridge 80 detected by the temperature sensor 87*a* is recorded in the IC card 86. The IC card 86 is read when the toner cartridge 80 is exchanged, and the quality of an unused toner cartridge 80 is determined based on the maximum temperature recorded in the IC card 86. If the maximum temperature recorded in the IC card 86 reaches the toner color erasing temperature, then it is determined that the held color erasable toner is erased, and that the unused toner cartridge 80 is a defective product. The user is notified of the result of the quality determination of the unused toner cartridge 80.

The exchange of the cartridge is carried out in a low-temperature environment to prevent a defective unused toner cartridge 80 with color erasable toner from being installed in the MFP 10. The replenishment of an erased toner from a defective unused toner cartridge 80 to the developer 18 is prevented. Thus deterioration of the developer 18 is prevented, and a high-quality printed image can be obtained.

According to at least one embodiment described above, the use of an improper color erasable toner which is erased if the cartridge is placed in a high-temperature environment in the image forming is prevented. Therefore, a high-quality printed image can be obtained, without mixing the erased color erasable toner on the formed image.

In at least one embodiment described above, the cartridge, which is not limited to a toner cartridge, may be an exchangeable developing cartridge in which a color erasable material is held or a developing cartridge in which a toner bottle is integrated with a developer. In the case of an inkjet type image forming apparatus, the cartridge may further be an ink cartridge for holding ink serving as a color erasable material. Moreover, the cartridge may further be a cartridge tape with the color erasable ink on the tape.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section having a cartridge detachably mounted thereto, the cartridge holding a decolorable material which is decolored by heating to a decoloring temperature, the image forming section configured to form an image with the decolorable material, wherein the cartridge includes a housing configured to hold the decolorable material and a temperature sensing unit configured to detect a storage temperature of the housing;

a display unit;

a memory configured to store a maximum storage temperature of the storage temperatures detected by the temperature sensing unit, wherein the memory:

stores the detected storage temperature as the maximum storage temperature if there is no previously stored storage temperature, stores the detected decolorable temperature over a previously stored storage temperature as the maximum storage temperature if the detected storage temperature is greater than the previously stored storage temperature, and does not store the detected storage temperature as the maximum storage temperature if the detected storage temperature is less than the previously stored storage temperature; and a control section configured to:

read the maximum storage temperature stored in the memory, determine whether the read maximum storage temperature is greater than the decoloring temperature, and control the display unit to display a message indicating whether the maximum storage temperature is greater than the decoloring temperature.

2. The apparatus according to claim 1, wherein the message indicates that a cartridge exchange operation is complete if the read maximum storage temperature is not greater than the decoloring temperature.

3. The apparatus according to claim 1, wherein the message indicates that the cartridge is defective if the read maximum storage temperature is greater than the decoloring temperature.

4. The image forming apparatus according to claim 1, wherein:

the control section reads the maximum temperature from the cartridge when the cartridge is mounted in the image forming apparatus.

5. The image forming apparatus according to claim 1, wherein the cartridge further includes an integrated circuit card, and the memory is included in the integrated circuit card.

6. A method for notifying a state of a cartridge, the method comprising the steps of:

controlling a memory unit to selectively store a storage temperature detected by a temperature sensing unit as a maximum storage temperature of the cartridge so that:

the detected storage temperature is stored as the maximum storage temperature if there is no previously stored storage temperature, the detected temperature is stored over a previously stored storage temperature if the detected storage temperature is greater than the previously stored storage temperature, and the detected storage temperature is not stored if the detected storage temperature is less than a previously stored storage temperature;

receiving the maximum stored storage temperature of the cartridge;

determining whether the received maximum stored storage temperature is greater than a decoloring temperature; and displaying a message indicating whether the received maximum stored storage temperature is greater than the decoloring temperature.

7. The method according to claim 6, wherein the message indicates that a cartridge exchange operation is complete if the received maximum stored storage temperature is not greater than the decoloring temperature.

8. The method according to claim 6, wherein the message indicates that the cartridge is defective if the received maximum stored storage temperature is greater than the decoloring temperature.

9. The method according to claim 6, further comprising, reading the maximum stored storage temperature from the cartridge when the cartridge is mounted in an image forming apparatus.

10. The method according to claim 6, wherein:

the memory unit is included in an integrated circuit, and the received maximum storage temperature is read from the integrated circuit.

11. An image forming apparatus, comprising:

an image forming section having a cartridge detachably mounted thereto, the cartridge holding a decolorable material which is decolored by heating to a decoloring color erasing temperature, the image forming section configured to form an image with the decolorable material, wherein the cartridge includes a housing configured to hold the decolorable material and a temperature sensing unit configured to detect a storage temperature of the housing;

a display unit;

a memory configured to store a maximum storage temperature of the storage temperatures detected by the temperature sensing unit, wherein the memory:

stores the detected storage temperature as the maximum storage temperature if there is no previously stored storage temperature, stores the detected storage temperature over a previously stored storage temperature as the maximum storage temperature if the detected storage temperature is greater than the previously stored storage temperature, and does not store the detected storage temperature as the maximum storage temperature if the detected storage temperature is less than the previously stored storage temperature;

a reading control section configured to read the maximum storage temperature stored in the memory; and a cartridge determination section configured to determine whether the read maximum storage temperature is greater than the decoloring temperature; and an operation panel control section configured to control the display unit to display a message indicating whether the read maximum storage temperature is greater than the decoloring temperature.

12. The apparatus according to claim 11, wherein the message indicates that a cartridge exchange operation is complete if the read maximum storage temperature is not greater than the decoloring temperature.

13. The apparatus according to claim 11, wherein the message indicates that the cartridge is defective if the read maximum storage temperature is greater than the decoloring temperature.

14. The image forming apparatus according to claim 11, wherein:

the control section reads the maximum temperature from the cartridge when the cartridge is mounted in the image forming apparatus.

* * * * *